US006773070B2

(12) United States Patent
Worledge et al.

(10) Patent No.: US 6,773,070 B2
(45) Date of Patent: Aug. 10, 2004

(54) APPARATUS AND METHOD FOR PROVIDING A PORTABLE VARIABLY POSITIONABLE SEATING DEVICE

(75) Inventors: David H. Worledge, Corrales, NM (US); Karen T. Urbielewicz, Corrales, NM (US); Donald V. Urbielewicz, Corrales, NM (US); Jeffrey R. Lynch, Corrales, NM (US)

(73) Assignees: David H Worledge, Corrales, NM (US); Pamela Worledge, Corrales, NM (US); Donald V Urbielewicz, Corrales, NM (US); Karen T Urbielewicz, Corrales, NM (US)

( * ) Notice: Subject to any disclaimer, the term of this patent is extended or adjusted under 35 U.S.C. 154(b) by 92 days.

(21) Appl. No.: 10/087,698

(22) Filed: Mar. 1, 2002

(65) Prior Publication Data

US 2003/0164636 A1 Sep. 4, 2003

(51) Int. Cl.[7] ..... A47C 1/02

(52) U.S. Cl. ..... 297/344.21; 297/45; 297/51; 297/440.11; 297/344.18

(58) Field of Search ..... 297/16.1, 16.2, 297/45, 51, 440.11, 440.16, 397, 391, 380, 344.21, 344.18

(56) References Cited

U.S. PATENT DOCUMENTS

| | | | | |
|---|---|---|---|---|
| D179,376 | S | 12/1956 | Breed | D15/1 |
| 3,870,270 | A | 3/1975 | Holtz | 248/406 |
| 4,482,184 | A | 11/1984 | Mincey | 297/28 |
| 4,824,170 | A | 4/1989 | Goldmeier | 297/349 |
| 5,209,549 | A | 5/1993 | Chang et al. | 297/320 |
| 5,364,163 | A | 11/1994 | Hardison | 297/344.21 |
| 5,567,014 | A | 10/1996 | Fitch | 297/344.21 |
| 5,611,594 | A | 3/1997 | Findlay | 297/28 |
| 5,931,530 | A | 8/1999 | Liu | 297/270.3 |
| 5,944,384 | A | 8/1999 | Patterson | 297/344.23 |
| 6,116,682 | A | 9/2000 | Baur | 297/181 |
| 6,238,001 | B1 | 5/2001 | Yoran | 297/316 |
| 2003/0020312 | A1 | 1/2003 | Wang | 279/344.18 |

FOREIGN PATENT DOCUMENTS

WO PCT/EP90/00394 9/1990

OTHER PUBLICATIONS

Four sheets printed from the web site of Suntracker, Inc.; apparent author is RBF Company, date of publication 1999, place of publication is the Web. Applicants believe, but do not know, that the apparatus shown in the enclosed four pages may be related to the apparatus shown in U.S. patent No. 5,611,594 issued Mar. 18, 1997 to Findlay, previously included with the original Information Disclosure Statement filed with the subject patent application.

*Primary Examiner*—Peter M. Cuomo
*Assistant Examiner*—Stephanie Harris
(74) *Attorney, Agent, or Firm*—Ray R. Regan

(57) ABSTRACT

An apparatus and method for providing a portable variably positionable seating device is provided. The apparatus and method for providing a portable variably positionable seating device, according to the present invention, includes a plurality of tines. In one embodiment, at least two of tines include a boom that swivels on one end of the tines. Also included are one or more removable panels that engage with the tines and will support a person. A support assembly is also provided, and is pivotally connectable to the tines. The support assembly includes at least a first tube. A plurality of arms, pivotally connected to the tines and to the support assembly, are included. Also included is a carriage device. The carriage device is slidably and rotationally positioned on the first tube of the support assembly. A plurality of legs, pivotally attached to the carriage device, are included.

36 Claims, 6 Drawing Sheets

FIG 2 Adjustable Chair (10)
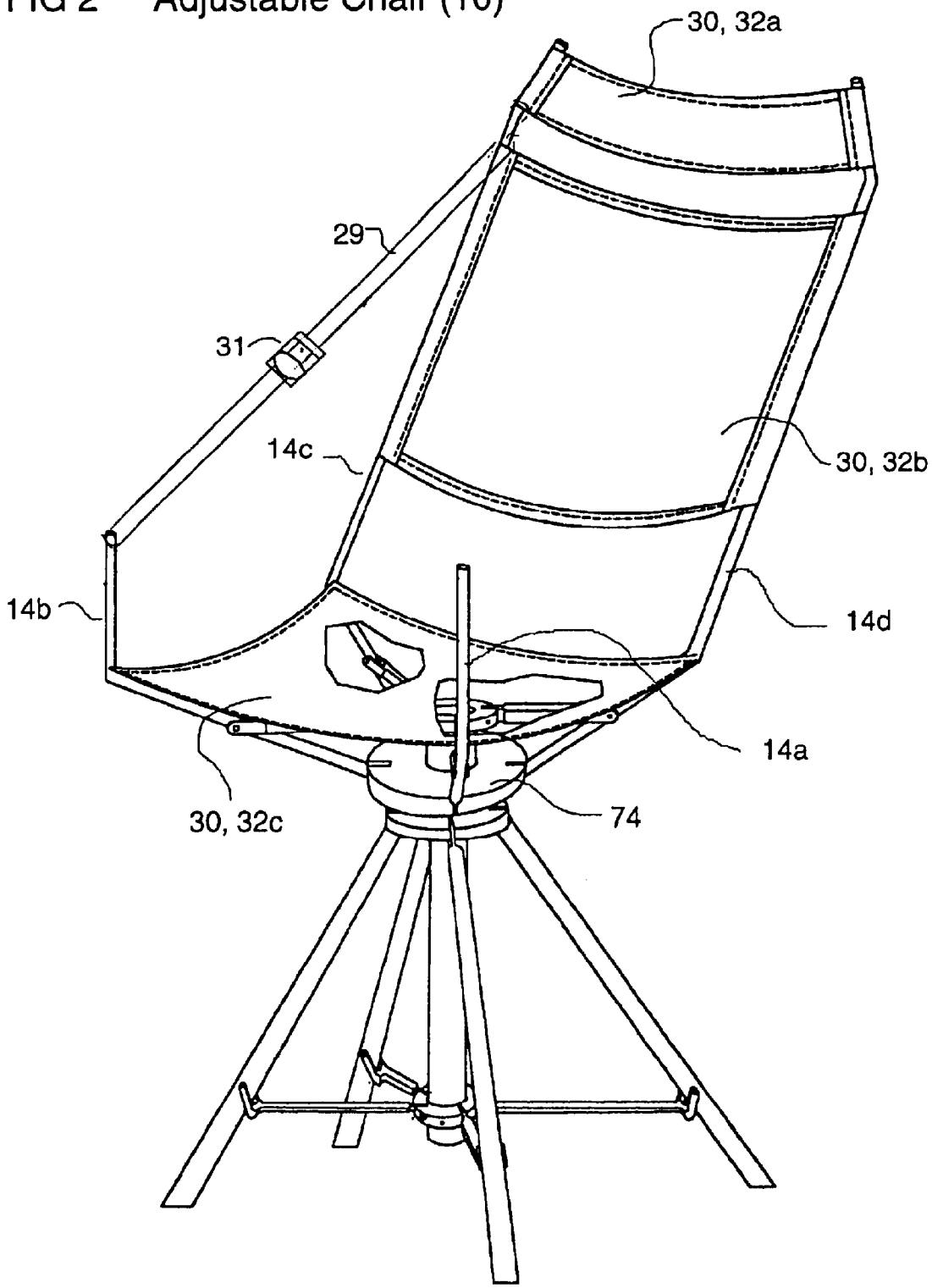

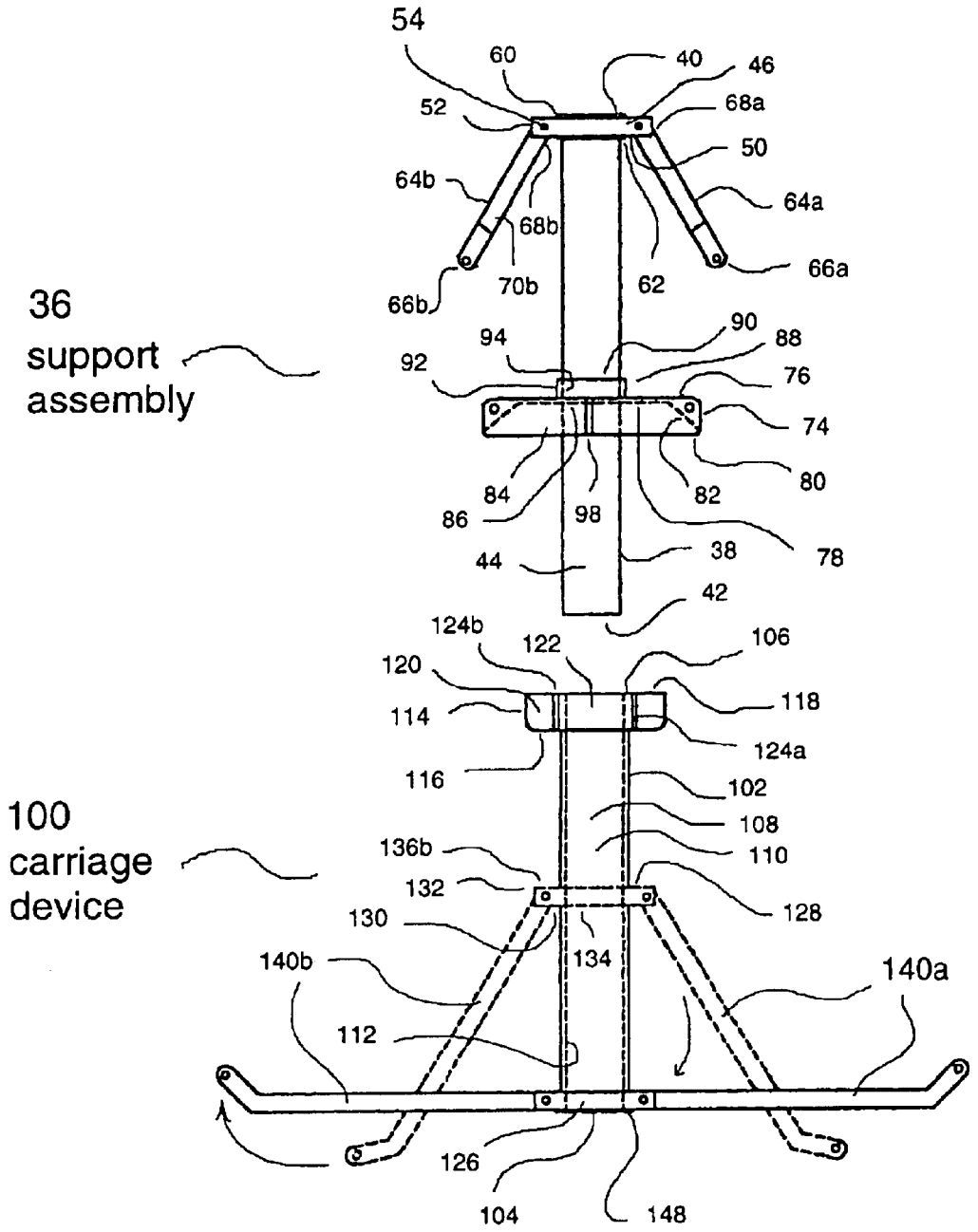
FIG 6 Multiply Positionable Coupler (34)

APPARATUS AND METHOD FOR PROVIDING A PORTABLE VARIABLY POSITIONABLE SEATING DEVICE

FIELD OF THE INVENTION

The present invention pertains generally to chairs. More particularly, the new and useful invention claimed in this document pertains to an apparatus and method for providing a portable variably positionable seating device that permits a person to fold and deploy a rotatable adjustable chair to provide substantially unrestricted three dimensional configurations. While the chair of the present invention is useful in a wide variety of environments and conditions including offices, homes, and similar locations, the present invention is particularly, but not exclusively, useful outdoors in connection with viewing nature, birds, animal life, sports and similar spectator events, and hunting.

BACKGROUND OF THE INVENTION

Perhaps the most prevalent item of furniture is the chair. In occidental countries, the chair is ubiquitous, appearing inside homes in virtually every room; outside homes in, for example, backyards and patios; in work environments such as offices; and at athletic and sport events. A form of chair is included in every automobile and truck. The earliest known chair, a three-legged stool started in Egypt some 5,000 years ago, underwent evolution to arm chairs, even thrones; to massive stationary pieces of furniture; and to portable chairs, all with countless styles, functions, compositions, and structures.

Today, most chairs and related apparatus and systems for providing a seating device are monolithic and not readily portable four legged structures of wood and stuffed cloth. Few are designed for multiple uses to include, without limitation, use within interiors of buildings, as well as outdoors in environments that may include all terrestrial locations including backyards, patios, woods, mountains, sea shores and similar diverse conditions and locations. Few adjustable seating devices are provided for multiple uses. As used in this document, the term "adjustable" means and includes at least the capacity of components of a chair to rotate, both clockwise and counterclockwise; to be positioned in a variety of varying heights and elevations; to slidably move in various directions to enhance the capacity to fold the components for transportation; to expand into a useable configuration quickly and easily; and to adjust to varying terrain; and to repeat the adjustable steps repeatedly.

In prior approaches, various means for providing a portable chair have been used or suggested, but are subject to many limitations. The limitations of such prior approaches include, for example, chairs that are not adjustable. Thus, many prior approaches do not allow the seat or seat-and-back member to rotate both clockwise and counterclockwise, or be positioned in a variety of varying heights and elevations, or to slidably move in various directions to enhance the capacity to fold components for transportation, or to expand into useable configurations quickly and easily, or to adjust to varying terrain in outdoor environments.

Additional limitations of the prior inventions include excessive weight, nonportability, and the inability to use the device in various and varying environments. Another limitation of the prior approaches includes inordinate complexity due to the use of complex bearing and spring components for rotation of components of the chair. In addition, many prior approaches clearly are not useable outside a building. Many do not fold, or collapse, for ready porting.

Therefore, a previously unaddressed need exists in the industry for a new and useful apparatus and method for providing a portable variably positionable seating device that permits a person to fold and deploy a rotatable adjustable chair to provide substantially unrestricted three dimensional configurations. Particularly, there is a significant need for a chair that rotates both clockwise and counterclockwise; that may be positioned and repositioned in a variety of varying heights and elevations; the provides support for a user's head, shoulders, and limbs; that may be moved in various directions to enhance the capacity to fold the operable components for transportation; that may expand into a useable configuration quickly and easily, while adjusting to varying terrain; be comparatively light in weight; and be portable and comfortable. There also is a need for such a chair and seating system that is useful outdoors for viewing nature, birds, animal life, sports and similar spectator events, hunting, and similar uses.

SUMMARY OF THE INVENTION

Given the conventional solutions for attempting to solve problems associated with providing an adjustable chair, such as a portable variably positionable seating system, it would be desirable, and of considerable advantage to provide in an adjustable chair of the present invention a chair that rotates both clockwise and counterclockwise; that may be positioned and repositioned in a variety of varying heights and elevations; that may be moved in various directions to enhance the capacity to fold components for transportation; that may expand into useable configurations quickly and easily, while adjusting to varying terrain; be comparatively light in weight; and be portable and comfortable. There also is a need for such a chair and seating system that is useful outdoors for viewing nature, birds, animal life, sports and similar spectator events, hunting, and similar uses.

The present invention provides numerous advantages. At least one of the advantages of the present invention is that it provides an adjustable chair that includes at least the capacity of a support member, or panels comprising at least a seat and back support, to rotate around the longitudinal axis through substantially the center of the adjustable chair ("Principal Longitudinal Axis").

Another advantage of the present invention is the use of a multiply positionable coupler, a unique element and component of the present invention, that permits rotation clockwise and counterclockwise around the Principal Longitudinal Axis.

Yet another advantage of the present invention is the chair's capacity to slidably move in at least two directions along, and substantially coincident with, the Principal Longitudinal Axis.

Still another advantage of the present invention is the chair's capacity to be folded, or collapsed, and unfolded, and to do so in both instances quickly and readily.

Another advantage of the present invention is the adjustability of the chair's legs to a wide variety of terrain.

Still another advantage of the present invention is the comparative light weight, portability and comfort of the adjustable chair that is a portable variably positionable sitting system.

Yet another advantage of the present invention is an adjustable chair, and a method for manufacturing the adjustable chair, which respectively are easy to use and to practice, and which are cost effective for their intended purposes.

These and other advantages are achieved in the present invention by providing an adjustable chair that includes a plurality of tines. The tines are formed into a ribbed cage. At least two of the tines may include a boom mounted on one end of the two tines, a boom that may be swivelled. A support member, or one or more removable panels, are provided for supporting a person's seat, back, head and selected portions of limbs. The one or more removable panels are engageable with and removable from, the plurality of tines. In addition, a support assembly and a carriage device are included. The support assembly is pivotally connected to the plurality of tines. The support assembly includes a first tube and a plurality of arms pivotally connected to both the support assembly and to the plurality of tines. In addition, the support assembly includes an upper collar mountable by slidably engaging the upper collar on the first tube. The upper collar also is rotatably engageable with the first tube. A first retaining ring is connected to one end of the first tube for preventing disengagement of the support assembly from the first tube, and a second retaining ring engageable with the first tube. The support assembly also includes a plurality of arms that are pivotally connected both to the support assembly and to the plurality of tines. In addition, the support assembly includes a lower collar that is slidably engageable with the first tube for positioning the tines. A guide extension also is formed in the lower collar that is slidably engageable with the first tube for distributing rotational, compressive and translational forces along the first tube to facilitate self-alignment during movement of the lower collar. The support assembly also includes means for movably connecting the plurality of legs to the support assembly.

As indicated, the present invention also includes a carriage device. The carriage device is slidably and rotationally positionable on the first tube of the support assembly. The portable chair also includes a plurality of legs pivotally attached to the carriage device, as well as a plurality of struts pivotally connected to the carriage device and to the plurality of adjustable legs. The carriage device also includes a second tube slidably engageable with the first tube. A fixed collar is included. The fixed collar is attached to one end of the second tube for movably connecting the plurality of legs and for restraining movement of the support assembly. The carriage device also includes means for positioning and repositioning the plurality of legs.

It will become apparent to one skilled in the art that the claimed subject matter as a whole, including the structure of the apparatus, and the cooperation of the elements of the apparatus, combine to result in a number of unexpected advantages and utilities. The advantages and objects of the present invention, and features of such an adjustable chair, such as a portable variably positionable seating system, will become apparent to those skilled in the art when read in conjunction with the accompanying following description, drawing figures, and appended claims.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways and in various environments. Also, the phraseology and terminology employed in this disclosure are for purpose of description, and should not be regarded as limiting.

As those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

BRIEF DESCRIPTION OF THE DRAWING

FIG. 2 is a perspective view of the assembled portable variably positionable seating device, according to the present invention, showing a partially cut-away support member installed;

FIG. 6 is a side cross-sectional view of the multiply positionable coupler, according to the present invention, including a phantom configuration of the partially folded multiply positionable coupler along the line 1—1 in FIG. 1.

DESCRIPTION OF A PREFERRED EMBODIMENT

Briefly, the present invention provides an adjustable chair that includes a plurality of tines. The tines are formed into a ribbed cage. At least two of the tines may include a boom mounted on one end of the two tines that may be swivelled. One or more removable panels are provided for supporting a person. The one or more removable panels are engageable with and removable from the plurality of tines. In addition, a support assembly is included. The support assembly is pivotally connected to the plurality of tines. The support assembly includes a first tube and a plurality of arms pivotally connected to both the support assembly and the plurality of tines. In addition, the support assembly includes an upper collar slidably and rotatably engageable with the first tube, a first retaining ring connected to one end of the first tube for preventing disengagement of the support assembly from the first tube, and a second retaining ring engageable with the first tube. The support assembly also includes a plurality of arms that are pivotally connected both to the support assembly and to the plurality of tines. In addition, the support assembly includes a lower collar that is slidably engageable with the first tube for positioning the plurality of tines. A guide extension is provided on the lower collar that is slidably engageable with the first tube for distributing rotational, compressive and translational forces along the first tube during movement of the lower collar, and to facilitate self-alignment. The support assembly also includes means for movably connecting the plurality of legs to the support assembly.

The present invention also includes a carriage device. The carriage device is slidably and rotationally positionable on the first tube of the support assembly. The portable chair also includes a plurality of legs pivotally attached to the carriage, as well as a plurality of struts pivotally connected to the carriage device and to the plurality of adjustable legs. The carriage device includes a second tube slidably engageable with the first tube. A fixed collar is included. The fixed collar is attached to one end of the second tube for movably connecting the plurality of legs and for restraining movement of the support assembly. The carriage device also includes means for positioning and repositioning the plurality of legs.

Figure 1:
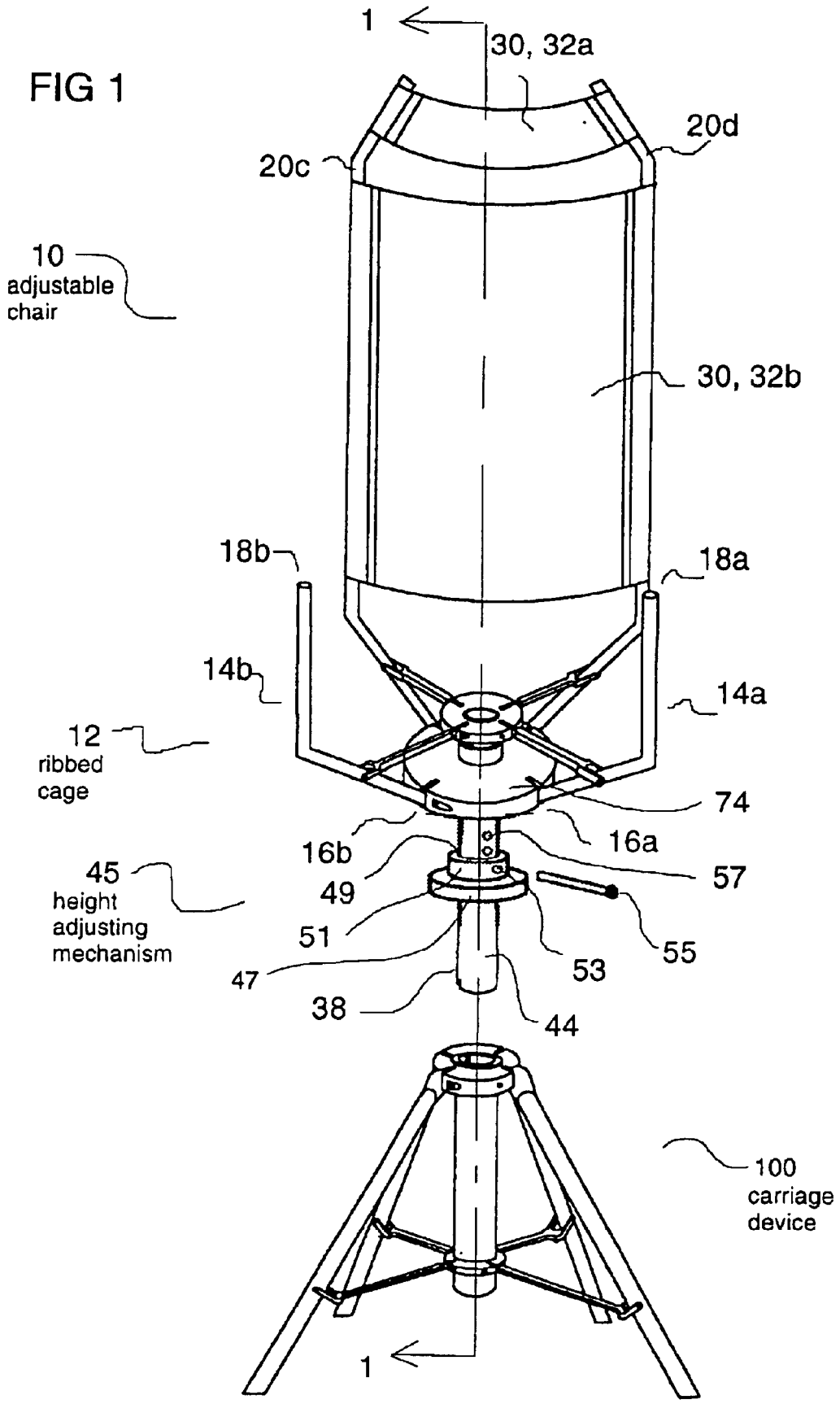
FIG. 1 is an exploded perspective view of the apparatus for providing a portable variably positionable seating device.

In more detail and, referring initially to FIG. 1, the apparatus for providing an adjustable chair is shown and generally designated 10. As shown, adjustable chair 10 includes a ribbed cage 12. Ribbed cage 12 includes a plurality of tines 14 *a–d* having a leading end 16 and a following end 18. In a preferred embodiment of the present invention, at least two of plurality of tines 14 *a–d* include a removable boom 20. As shown best in FIG. 3*a*, removable boom 20 is formed with a sleeve 22 extending inwardly radially from the first end 24 of removable boom 20 that also is formed with second end 26. Also in a preferred embodiment of the present invention, on which removable boom 20 is connectable by inserting sleeve 22 into a recess 28 in following end 18 of at least two 14 *c,d* of plurality of tines 14 *a–d*. Removable boom 20 is therefore rotatable within recess 28. In operation, removable boom 20 contributes to support of a user's head during use of adjustable chair 10, as well as to folding, or collapsing ribbed cage 12 to enhance portability and transportation of adjustable chair 10 between locations. In a preferred embodiment of the present invention, as best shown by reference to FIG. 2, one or more adjustable straps 29 is provided. FIG. 2 shows only one adjustable strap 29 as an example. One or more adjustable straps 29 are included to provide support for equipment possessed by a user of adjustable chair 10, and to enhance stability of adjustable chair as a whole when deployed for use. Adjustable strap 29 may be extended from one or more of plurality of tines 14*b* to one or more other of plurality of tines 14*c*. As will be evident to one skilled in the art, any number of means may be used to make adjustable strap 29 adjustable, including, without limitation, for example, a buckle 31 as also shown in FIG. 2.

Figure 3B:
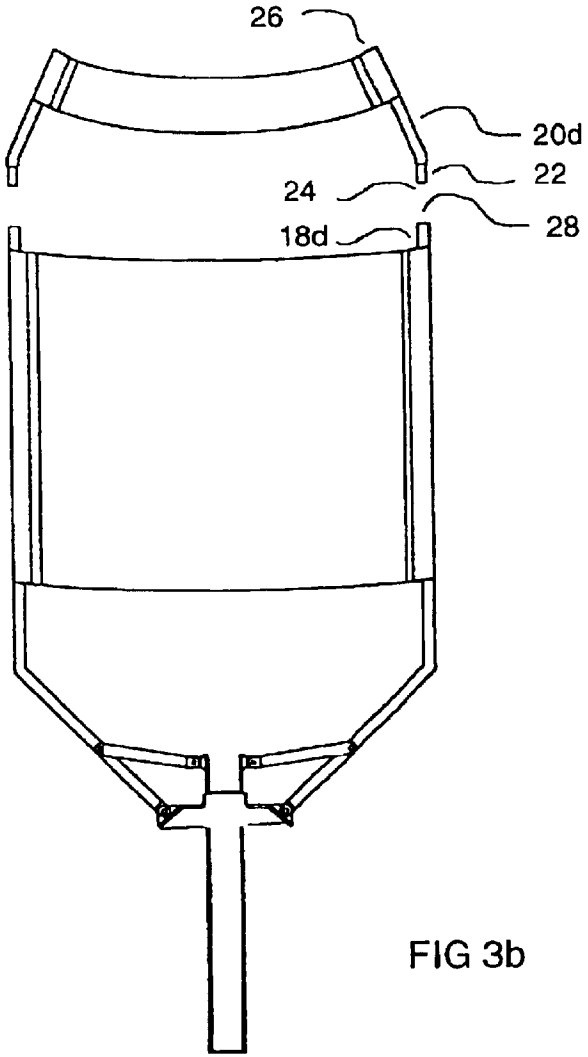
FIGS. 3*a* and 3*b* are front, cross-sectional views of the support assembly, according to the present invention along the line 1—1 in FIG. 1.
Figure 3A:
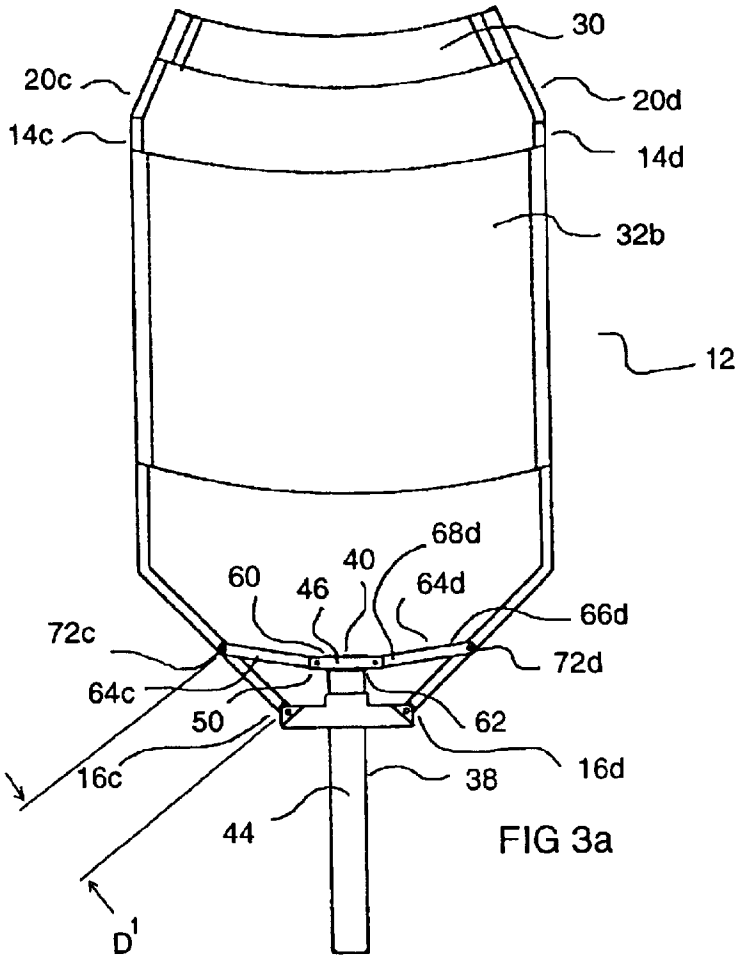

As shown best by cross-reference between FIGS. 1–2, as well as in FIG. 3*a*, adjustable chair 10 also includes at least one support member 30 removably engageable with ribbed cage 12. The at least one support member 30 is provided for supporting a person on adjustable chair 10 during use. As will be evident to one skilled in the art, support member 30 of the present invention may be formed in any number and variety of shapes and configurations. In a preferred embodiment of the present invention, at least one support member 30, as shown best in FIG. 2, includes one or more panels 32*a–c* comprising a head portion 32*a*, a back portion 32*b*, and a seat portion 32*c*, for supporting a person.

As also shown in FIGS. 1–2, and perhaps best by cross-referenced to FIG. 6, adjustable chair 10 includes a multiply positionable coupler 34. Multiply positionable coupler 34 includes a support assembly 36. Support assembly 36 is formed with a first tube 38 having a proximal end 40, an distal end 42, and a circumferential surface 44 between proximal end 40 and distal end 42. In a preferred embodiment of the present invention, first tube 38 is hollow. As will be evident to one skilled in the art, however, a hollow first tube 38 is not a material limitation on the present invention, and may be determined by the material or materials used in manufacturing and constructing commercial embodiments of the present invention. As will also be evident to a person skilled in the art, material and materials used in manufacturing and constructing the present invention are not a limitation on the present invention. However, in a preferred embodiment of the present invention, components and elements other than support member 30 are made of anodized aluminum. As also will be evident to one skilled in the art, neither the use of terms such as "circumferential surface 44," nor the shapes described in at least one embodiment described in this document, are limitations on the present invention. In commercial embodiments of the present invention, the cross-section of various components and elements described in this document may be other than annular or circular, and may include at least square, rectangular and triangular cross-sections. As also shown in FIG. 1, a height adjusting mechanism 45 is provided. In a preferred embodiment of the present invention, height adjusting mechanism 45 includes a plate 47 formed with a passage 49 slidably engageable with first tube 38, one or more supports that, as shown, may be in the form of an annular collar 51 formed with one or more first voids 53 through which one or more pins 55 may be removably inserted for engagement with one or more second voids 57 formed through circumferential surface 44 of first tube 38 for varying the height of adjustable chair 10. As will be evident to one skilled in the art, height adjusting mechanism 45 is not a limitation of the present invention, and any number of alternative devices for adjusting the height of adjustable chair 10 may be used in connection with the present invention.

Figure 4:
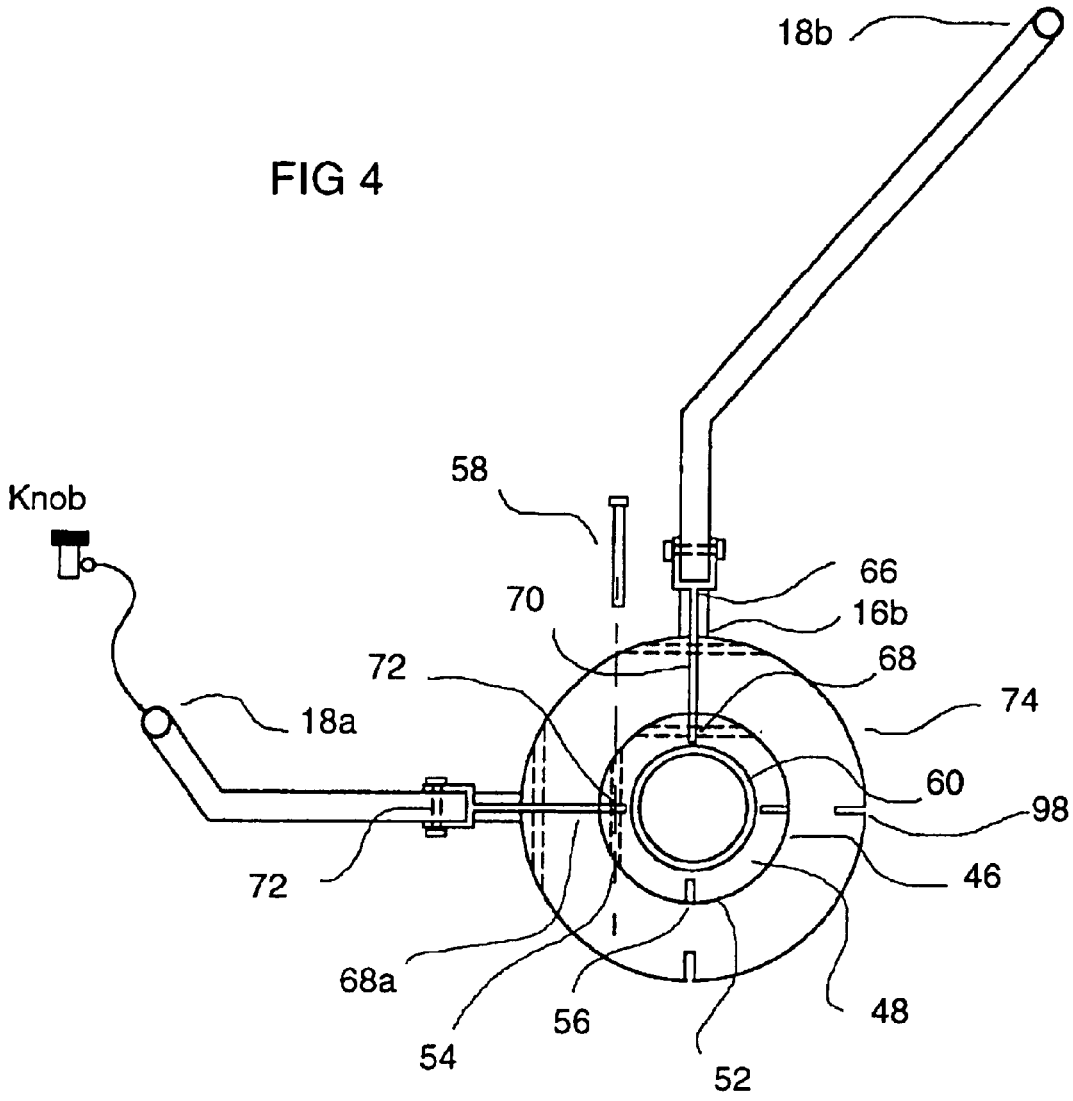
FIG. 4 is a partial top view of the support member showing selected components.

As perhaps best shown in FIG. 6, support assembly 36 of adjustable chair 10 also includes an upper collar 46. Upper collar 46 is slidably engageable with first tube 38. As best shown by cross-reference between FIGS. 4 and 6, upper collar 46 is formed with an upper surface 48, a lower surface 50, and a wall 52 between upper surface 48 and lower surface 50. Further, a hole 54 is formed in the approximate center of wall 52. In addition, a plurality of slots 56*a–d* are formed in wall 52. Plurality of slots 56*a–d* in wall 52 extend radially toward the longitudinal axis through the center of hole 54 of upper collar 46. One or more connecting devices 58*a–d* may be inserted in plurality of slots 56*a–d* transverse to plurality of slot 56*a–d* as best shown in FIG. 4. As used in this document, the term "connecting device" or "connecting devices" includes, but is not limited to, rods, bolts, dowels, joints, keepers, pins, rivets and similar means for connecting components that a person skilled in the art would recognize as useful in providing a device on which other components and elements of the present invention may be rotatably and movably fastened. Support assembly 36 of adjustable chair 10, in accordance with the present invention, also includes a first retaining ring 60. First retaining ring 60 is mounted on first tube 38 to abut proximal end 40 of first tube 38. First retaining ring 60 assists in preventing disengagement of support assembly 36 from first tube 38. In a preferred embodiment of the present invention, support assembly 36 also includes a second retaining ring 62. Second retaining ring 62 is engageable with lower surface 50 of upper collar 46 and with circumferential surface 44 of first tube 38. As also shown by cross-reference between FIGS. 3*a*, 4 and 6, also included in support assembly 36 of adjustable chair 10 are a plurality of arms 64*a–d*. Plurality of arms 64*a–d* are formed with a fore end 66 and aft end 68, and an elongated body 70 between fore end 66 and aft end 68. In addition, one or more connection holes 72 are formed adjacent to fore end 66 and aft end 68 of plurality of arms 64. As shown in FIGS. 1–2, and perhaps best by cross-reference to FIG. 6, aft end 68 of plurality of arms 64*a–d* are pivotally connected into plurality of slots 56*a–d* of upper collar 46 using one or more connection devices 58. As also shown in FIGS. 3*a* and 3*b*, fore end 66 of plurality of arms 64*a–d* are pivotally connectable to connection holes 72*a–d* formed a distance $D^1$ from leading end 16*a–d* of plurality of tines 14*a–d*, using one or more connection devices 58.

As further shown by cross-reference between FIGS. 1–3, as well as FIG. 6, support assembly 36 of adjustable chair 10 also includes a lower collar 74. Lower collar 74 is slidably engageable with first tube 38. Lower collar 74 is formed with an exterior surface 76, an interior surface 78, a lower edge 80, and an annular surface 82. Lower collar 74 thus is further formed with a cavity 84 between lower edge 80 and interior surface 78, and an opening 86 formed through exterior surface 76, interior surface 78 and cavity 84 substantially coincident with the longitudinal axis of first tube 38 and lower collar 74 when lower collar 74 is slidably engaged with first tube 38. In addition, support assembly 36 in accordance with the present invention includes a guide extension 88. Guide extension 88 abuts exterior surface 76 of lower collar 74. Guide extension 88 is slidably engageable with first tube 38. Further, guide extension 88 is formed with an orifice 90, an exterior face 92 and an interior face 94. Guide extension 88 extends from exterior surface 76 of lower collar 74 toward proximal end 40 of first tube 38. Guide extension 88, in operation, is useful in distributing rotational, compressive, and translational forces along first tube 38 during movement of lower collar 74 along first tube 38 both toward proximal end 40 of first tube 38 and distal end 42 of first tube 38. Support assembly 36 of adjustable chair 10 also includes a plurality of notches 98*a–d* formed in lower collar 74. Plurality of notches 98*a–d* in lower collar 74 are formed through annular surface 82 of lower collar 74 extending inwardly radially toward the longitudinal axis of lower collar 74. In operation, one or more connection devices 58 may be inserted transverse to plurality of notches 98 formed in lower collar 74 for pivotally connecting following end 16*a–d* of plurality of tines 14*a–d* forming ribbed cage 12.

Multiply positionable coupler 34 of adjustable chair 10, in accordance with the present invention, also includes a carriage device 100. Carriage device 100 is perhaps best shown by cross-reference among FIGS. 1–2, and 5–6. Carriage device 40 is formed with a second tube 102. Second tube 102, in a preferred embodiment of the present invention, is hollow. Second tube 102 is formed with an anterior end 104, a posterior end 106, and an outer surface 108 between anterior end 104 and posterior 106 end. Second tube 102 is further formed with a lumen 110 and an inner surface 112. Circumferential surface 44 of first tube 38 is slidably engageable with lumen 110 and inner surface 112 of second tube 102. In an alternative embodiment of the present invention, a bearing pad (not shown) may be attached to rear surface 118 of collar 114, or in the alternative, attached to interior surface 78 of lower collar 74. Such a bearing pad would be made of nylon, plastic, or similar material to enhance movement of the components parts on frictional surfaces.

In addition, carriage device 100 of multiply positionable coupler 34, in accordance with the present invention, also includes a fixed collar 114. Fixed collar 114 is attached to posterior end 106 of second tube 102. Fixed collar 114 is formed with a forward surface 116, a rear surface 118 and a body 120 between forward surface 116 and rear surface 118. In a preferred embodiment of the present invention, a duct 122 is formed through the approximate center of body 120 of fixed collar 114. In addition, a plurality of slits 124*a–d* is formed in body 120 of fixed collar 114. The plurality of slits 124*a–d* extend radially toward the longitudinal axis through the center of fixed collar 114 and second tube 102 of carriage device 100. As will be apparent to one skilled in the art, plurality of slits 124*a–d* are not a limitation on the present invention, nor are the plurality of slots 56*a–d* associated with upper collar 46, nor are the plurality of notches 98*a–d* in lower collar 74, and any number of alternative configurations may be provided for connecting the components.

In addition, carriage device 100 also includes a barrel 126 that is slidably engageable with second tube 102. Barrel 126 is formed with an initial surface 128, a subsequent surface 130, and a neck 132 between initial surface 128 and subsequent surface 130. Further, a bore 134 is formed through the approximate center of neck 132 of barrel 126. In addition, a plurality of apertures 136*a–d* is formed in neck 132. Plurality of apertures 136 extends radially toward the longitudinal axis through the center of barrel 126 and second tube 102. In addition, one or more connection devices 58 may be inserted transverse within and across plurality of apertures 136*a–d* formed in neck 132 of barrel 126 for pivotally connecting an end of a plurality of struts 140*a–d* also described below.

Figure 5A:
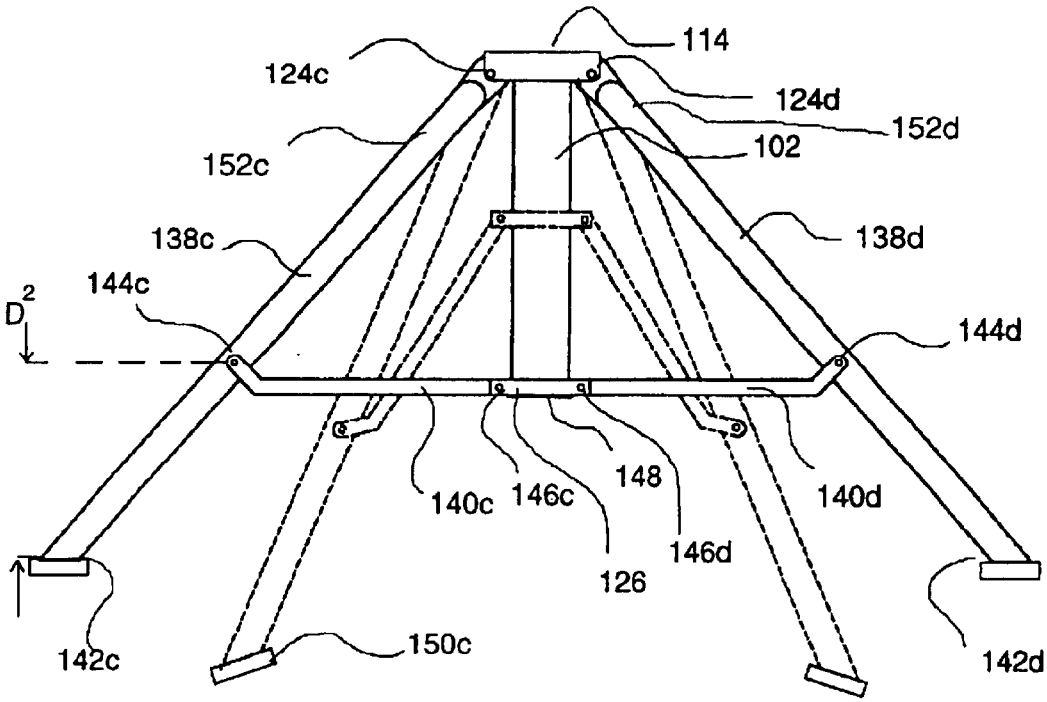
FIGS. 5*a* and 5*b* are side cross-sectional views of the carriage device according to the present invention, including in FIG. 5*a* a phantom configuration of the partially folded device along the line 1—1 in FIG. 1.
Figure 5B:
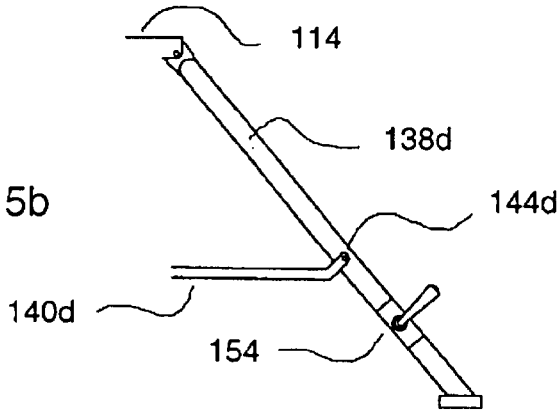

As shown best in FIGS. 5*a* and 5*b* but also in FIGS. 1–2, carriage device 100 of multiply positionable coupler 34 of adjustable chair 10 also includes, as stated, three or more variably configurable legs 138*a–d*. Three or more variably configurable legs 138*a–d* are movably fastened to multiply positionable coupler 34 at more than one location as perhaps best shown in FIG. 1, FIGS. 5*a* and 5*b*. In a preferred embodiment of the present invention, three or more variably configurable legs 138*a–d* are pivotally mounted to carriage device 100 by inserting one or more connection devices 58 through one or more connection holes 72 formed in three or more variably configurable legs 138*a–d* and slits 124*a–d* of fixed collar 114. In addition, one or more connection devices 58 are inserted through one or more connection holes formed in three or more variably configurable legs 138*a–d* a distance $D^2$ from first end 142*a–d* of three or more variably configurable legs 138*a–d* and through preliminary end 144*a–d* of plurality of struts 140*a–d*. Furthermore, secondary end 146*a–d* of plurality of struts 140*a–d* are pivotally connectable to plurality of apertures 136*a–d* formed in neck 132 of barrel 126. Carriage device 100 also includes a third retaining ring 148. Third retaining ring 148 is attached to anterior end 104 of second tube 102 of carriage device 100 of multiply positionable coupler 34.

Three or more variably configurable legs 138*a–d*, in a preferred embodiment of the present invention, also include a foot 150 mountable on end 142 of each of three or more variably configurable legs 138*a–d*, as shown in FIGS. 5*a* and 5*b* for contributing to the stability of adjustable chair 10 when chair 10 is placed for use on varying terrain, particularly outdoors. In an alternative embodiment of the present invention, as perhaps best shown in FIG. 5*b*, means 154 for positioning at least one leg 138*d* may be included. Means 154 for positioning at least one leg may include telescoping means or a locking mechanism (not shown) for shortening or lengthening at least one leg. In yet another embodiment of the present invention, means 154 for positioning at least one leg may also include, with or without the telescoping means, a lever and pawl mechanism 156, or similar apparatus, as shown in FIG. 5*b*, for positioning components of the at least one leg 138*d* in a variety of positions.

While the adjustable chair shown in drawing FIGS. 1 through 6 is one embodiment of the present invention, it is merely one embodiment of the invention, is not intended to be exclusive, and is not a limitation of the present invention. While the particular adjustable chair as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

Claim elements and steps in this document have been numbered and/or lettered solely as an aid in readability and understanding. The numbering is not intended to, and should not be considered as, intending to indicate the ordering or sequencing of elements and steps in the claims.

Operation

In operation, support member 30, which may consist of one or more panels 32*a–b*, is engaged with plurality of tines 14*a–d* of ribbed cage 12 of adjustable chair 10. In a preferred embodiment of the present invention, support member 30 and panels 32*a–b* are made of canvas or similar materials. Of course, as a person skilled in the art will immediately recognize, materials are not a limiting condition of the present invention. Because, however, multiply positionable coupler 34, in combination with the other elements of the present invention, present such an elegant solution to the problems of the prior suggestions, and because adjustable chair 10 presents such an aesthetically pleasing appearance, support member 30 may be made of a wide variety of other more expensive materials, including without limitation, leather and upholstery. In that embodiment, adjustable chair 10 could be used in an office environment, or similar indoor environment, by replacing feet 150*a–d* with a plurality of roller balls (not shown), or similar apparatus for moving adjustable chair 10 on a surface that is not outdoors, well known in the art.

Carriage device 100 is perhaps best shown in FIG. 5*a*. As shown in FIGS. 5 and 6, fixed collar 114 is attached to posterior end 106 of second tube 102. Barrel 126 is slidably engaged over outer surface 108 of second tube 102, and third retaining ring 148 is mounted on anterior end 104 of second tube 102. Preliminary end 144*a–d* of struts 140*a–d* are pivotally connected to each of the three or more legs 138*a–c* a distance $D^2$ from first end 142 of three or more legs 138. Secondary end 146*a–d* of struts 140*a–d* is connected to plurality of apertures 136*a–d* of barrel 126. Second end 152*a–d* of three or more legs 154*a–c* is pivotally connected to slits 124*a–d* in fixed collar 114.

First retaining ring 60 is attached to proximal end 40 of first tube 38 of support assembly 36 of multiply positionable coupler 34. Upper collar 46 is slidably engaged with circumferential surface 44 of first tube 38. In a preferred embodiment of the present invention, second retaining ring 62 is slidably engaged with circumferential surface 44 of first tube 38 as well as with lower surface 50 of upper collar 46. Guide extension 88 is monolithically or otherwise connected to exterior surface 76 of lower collar 74. Leading end 16*a–d* of plurality of tines 14*a–d* is pivotally engaged with plurality of notches 98*a–d* on lower collar 74. Fore end 66*a–d* of plurality of arms 64*a–d* is pivotally connected to plurality of tines 14*a–d* a distance $D^1$ from leading end 16*a–d* of plurality of tines 14*a–d*. Aft end 68*a–d* of plurality of arms 64*a–d* is pivotally connected to plurality of slots 56*a–d* in upper collar 46.

Distal end 42 of first tube 38 is slidably engaged with lumen 110 beginning at posterior end 106 of second tube 102. Adjustable chair 10 is therefore assembled in an operative configuration for use.

At least one of the remarkable advancements in the art provided by adjustable chair 10 is the manner in which multiply positionable coupler 34 allows a user to disassemble support assembly 36 from carriage device 100. In addition, what is remarkable is the ability of a user to apply light manual pressure between lower collar 74 and first tube 38 to fold and unfold the various components of support assembly 36. The same is true of carriage device 100: by applying light manual pressure on subsequent surface 130 of barrel 126 of carriage device 100, components of carriage device 100 may be expanded or retracted, collapsed or opened, to use and relocate or move chair 10 to a different location.

What is claimed is:

1. An adjustable chair, comprising:

a ribbed cage;

at least one support member removably engageable with the ribbed cage;

a multiply positionable coupler removably connectable to the ribbed cage, wherein the multiply positionable coupler includes a first tube and an upper collar slidably engageable with the first tube formed with a plurality of slots extending radially toward the longitudinal axis through the center of the first tube; and three or more variably configurable legs mounted on the multiply positionable coupler, wherein each of the three or more variably configurable legs is movably fastened to the to the multiply positionable coupler at more than one location.

2. An adjustable chair as recited in claim 1, wherein the ribbed cage includes a plurality of tines having a leading end and a following end.

3. An adjustable chair as recited in claim 2, wherein at least two of the plurality of tines further comprise a removable swivelable boom connectable to the following end of the at least two of the plurality of tines.

4. An adjustable chair as recited in claim 1, wherein the at least one support member includes a seat portion and back portion for supporting a person.

5. An adjustable chair as recited in claim 1, further comprising a first retaining ring abutting the proximal end of the first tube, and a second retaining ring engageable with the lower surface of the upper collar and with the circumferential surface of the first tube.

6. An adjustable chair as recited in claim 1 further comprising a plurality of arms pivotally connectable to the plurality of slots, the plurality of arms having a fore end, an aft end, and an elongated body between the fore end and aft end.

7. An adjustable chair as recited in claim 1, further comprising a lower collar slidably engageable with the first tube, the lower collar formed with an exterior surface, an interior surface, a lower edge, an annular surface, a cavity between the lower edge and interior surface, and an opening formed through the exterior surface, interior surface and cavity coincident with the longitudinal axis of the first tube.

8. An adjustable chair as recited in claim 1, further comprising a guide extension slidably engageable with the first tube and having an orifice, an exterior face, and interior face, and a band between the exterior face and interior face, the guide extension extending from the exterior surface of the lower collar.

9. An adjustable chair as recited in claim 6, wherein the lower collar includes a plurality of notches formed through the annular surface of the lower collar toward the longitudinal axis of the lower collar.

10. An adjustable chair as recited in claim 1, wherein the multiply positionable coupler includes a carriage device formed with a second tube having an anterior end, a posterior end, and an outer surface therebetween.

11. An adjustable chair as recited in claim 10, further comprising a fixed collar attached to the posterior end of the second tube, the fixed collar being formed with a forward surface, a rear surface, a body therebetween, a duct formed through the approximate center of the body, and a plurality of slits formed in the body extending radially toward the longitudinal axis through the center of the second tube.

12. An adjustable chair as recited in claim 10 further comprising a barrel slidably engageable with the second tube, the barrel formed with an initial surface, a subsequent surface, a neck therebetween, a bore formed through the approximate center of the neck, and a plurality of apertures formed in the neck extending radially toward the longitudinal axis through the center of the second tube.

13. An adjustable chair as recited in claim 12, further comprising a plurality of struts pivotally connectable to the apertures and to the three or more variably configurable legs.

14. An adjustable chair as recited in claim 13, wherein the second tube includes a third retaining ring attached to the anterior end of the second tube.

15. A portable variably positionable seating system as recited in claim 1 wherein the support assembly includes a guide extension slidably engageable with the first tube for distributing rotational, compressive, and translational forces along the first tube during movement of the lower collar.

16. A portable variably positionable seating system, comprising:

a plurality of tines
wherein at least two of the plurality of tines further comprises a swivelable boom;

one or mare removable panels engageable with the plurality of tines for supporting a person;

a support assembly pivotally connectable to the plurality of tines,
wherein the support assembly includes a first tube and further includes a plurality of arms pivotally connectable to the support assembly and to the plurality of tines;

a carriage device slidably and rotationally positionable on the first tube of the support assembly; and a plurality of legs pivotally attachable to the carriage device.

17. A portable variably positionable seating system as recited in claim 16, wherein the support assembly includes an upper collar slidably engageable with the first tube.

18. A portable variably positionable seating system as recited in claim 16, wherein the support assembly includes means for movably interconnecting the support assembly to the plurality of tines.

19. A portable variably positionable seating system as recited in claim 18, wherein the support assembly includes a plurality of arms pivotally connectable to the support assembly and to the plurality of tines.

20. A portable variably positionable seating system as recited in claim 16, wherein the support assembly includes a second retaining ring engageable with the first tube.

21. A portable variably positionable seating system as recited in claim 16, wherein the support assembly includes a lower collar slidably engageable with the first tube for positioning the plurality of tines.

22. A portable variably positionable seating system as recited in claim 16, wherein the support assembly includes means for movably connecting the plurality of legs to the support assembly.

23. A portable variably positionable seating system as recited in claim 16, wherein the carriage device includes a second tube slidably engageable with the first tube.

24. A portable variably positionable seating system as recited in claim 16, wherein the carriage device includes a fixed collar attached to one end of the second tube for movably connecting the plurality of legs and for restraining movement of the support assembly.

25. A portable variably positionable seating system as recited in claim 16, wherein the carriage device includes means for positioning the plurality of legs.

26. A variably adjustable chair, comprising:

a cage,
wherein the cage includes a plurality of ribs;

at least one support panel removably engageable with the cage;

means connectable to the cage for positioning in multiple configurations the variably adjustable chair,
wherein the positioning means includes a first tube and further includes a lower
collar slidably engagable with the first tube; and at least two adjustable legs pivotally attachable to the positioning means.

27. A variably adjustable chair as recited in claim 26, wherein the positioning means includes an upper collar slidably engageable with the first tube.

28. A variably adjustable chair as recited in claim 27, wherein the positioning means includes a first retaining ring abutting an end of the first tube.

29. A variably adjustable chair as recited in claim 28, wherein the positioning means includes a plurality of arms pivotally connectable to the upper collar.

30. A variably adjustable chair as recited in claim 29, wherein the positioning means includes a guide extension slidably engageable with the first tube.

31. A variably adjustable chair as recited in claim 30, wherein the positioning means includes a plurality of notches formed in the lower collar.

32. A variably adjustable chair as recited in claim 31, wherein the positioning means includes a carriage device slidably engageable with the first tube, the carriage device being formed with a second tube.

33. A variably adjustable chair as recited in claim 32, wherein the positioning means includes a fixed collar attached to an end of the second tube.

34. A variably adjustable chair as recited in claim 33, wherein the positioning means includes a barrel slidably engageable with the second tube.

35. A variably adjustable chair as recited in claim 34, wherein the positioning means includes a plurality of struts pivotally connectable to the barrel and to the at least two adjustable legs.

36. A variably adjustable chair as recited in claim 34, wherein the positioning means includes a third retaining ring attached to an end of the second tube.

* * * * *